US005530976A

United States Patent [19]

Horcher

[11] Patent Number: 5,530,976

[45] Date of Patent: Jul. 2, 1996

[54] LIFTING DEVICE WITH FLUID FILLED TRACTION ELEMENT FOR HANDICAPPED PERSONS

[75] Inventor: Stefan Horcher, Nidderau, Germany

[73] Assignee: Horcher GmbH, Nidderan, Germany

[21] Appl. No.: 238,943

[22] Filed: May 6, 1994

[30] Foreign Application Priority Data

May 7, 1993 [DE] Germany ..... 93 06 922.7 U

[51] Int. Cl.[6] ..... A61G 7/12

[52] U.S. Cl. ..... 5/89.1; 5/81.1 T; 294/140

[58] Field of Search ..... 5/89.1, 81.1, 449, 5/451, 455, 625; 294/140

[56] References Cited

U.S. PATENT DOCUMENTS 3,597,774 8/1971 Warren ..... 5/84.1

FOREIGN PATENT DOCUMENTS 1458175 12/1976 United Kingdom ..... 5/81.1
2050844 1/1981 United Kingdom ..... 5/89.1
9204003 3/1992 WIPO ..... 5/81.1

*Primary Examiner*—Alexander Grosz
*Attorney, Agent, or Firm*—Dennison, Meserole, Pollack & Scheiner

[57] ABSTRACT

A lifting device for handicapped persons, comprising a height-adjustable lifting arm with attachment points for the ends of a U-shaped traction element to be placed under the armpits and around the body of the person to be lifted and transported. In order to transfer forces evenly to the person during lifting, lowering or transporting, the traction element is formed from an elastic hose with sealed ends which can be filled with a fluid.

11 Claims, 2 Drawing Sheets

FIG. 2
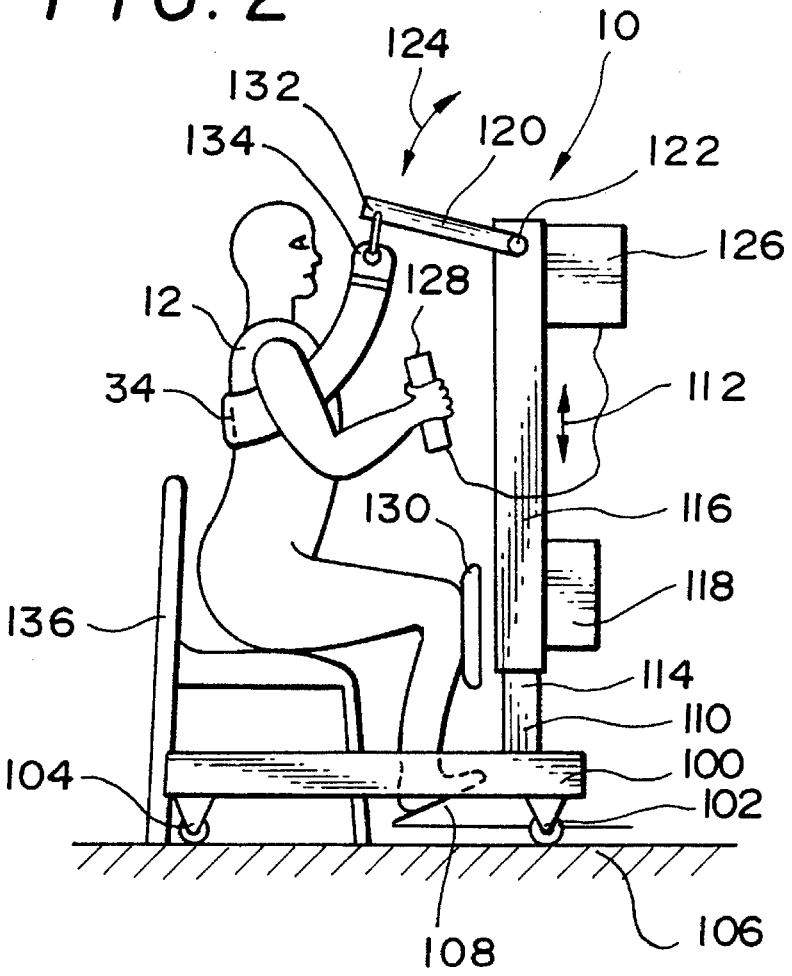
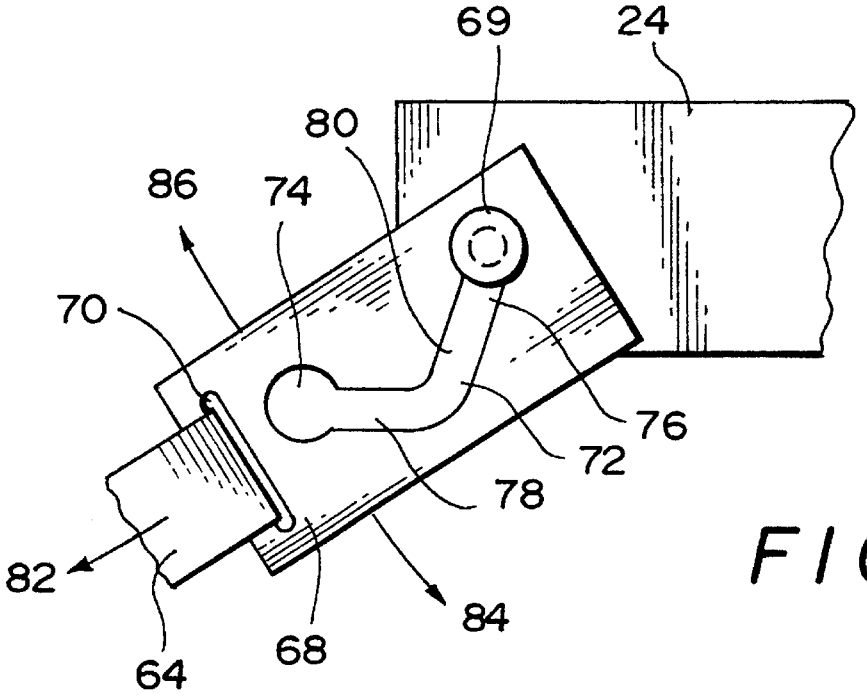
FIG. 3

LIFTING DEVICE WITH FLUID FILLED TRACTION ELEMENT FOR HANDICAPPED PERSONS

FIELD OF THE INVENTION

The invention relates to a lifting device for handicapped persons, comprising at least one height-adjustable lifting arm with at least one attachment point for one end of a traction element which can be placed under the armpits of the persons to be lifted or transported. The invention further relates to a lifting device for handicapped persons, in particular those in wheelchairs, comprising a stand which can preferably be rolled or displaced on a surface, at least one support originating at the stand and upwardly directed, at least one lifting arm laterally originating at the support and rotatable around an essentially horizontal axis and at least one attachment point disposed on the end of the lifting arm for ends of a traction element, wherein the traction element can be placed around persons to be lifted or transported.

BACKGROUND OF THE INVENTION

More or less elastic cables, straps or belts are used as traction elements in known lifting devices of the type mentioned at the outset. In order to prevent these from squeezing the bodies of these persons, in particular under the armpit, it is known to pad the traction elements. However, in spite of extensive padding it is hardly possible to transfer the traction forces to the persons in such a way that the persons do not feel the use of the lifting devices to be unpleasant.

In order to be able to clean the traction elements thoroughly for sanitary reasons, it is necessary for them to have smooth, washable surfaces. Therefore the padding needs to be provided with an appropriate cover.

OBJECT OF THE INVENTION

It is the object of the present invention to design a traction element in such a way that it can transfer forces very evenly and over large areas to the body of the persons to be transported. In addition, it is intended that it be possible with simple means to embody the traction element in such a way that it meets the sanitary conditions, particularly in respect to being washable.

This object is attained in accordance with the invention in that the traction element is an elastic hose or segment of such a hose, which can be filled with a fluid. In this case the hose or its segments can have a diameter in the range between 5 cm and 20 cm. Not only various gases, in particular air, can be used, but also various liquids, in particular water. However, gaseous fluids have the advantage of reduced weight.

A hose with the recited dimensions can be placed without problems under the armpits of persons. The traction elements are particularly placed under both armpits as well as around the back or around the chest. Because of the elasticity of the fluid-filled hose, its shape ideally conforms to the shape of the body of the persons. In this way the contact area is large and the surface load is evened out to a large extent and is small.

In accordance with a preferred embodiment, the hose consists of a fiber material, such as polyamide, which is sealingly coated with an elastomer. Hoses of this type are also known as fire hoses. The fiber material is sealed by a coating which is applied on the inside and/or outside. This coating can consist of a caoutchouc-like material which is applied by vulcanizing, in particular. The inner coating has the advantage in this case that the coating is pressed against the hose wall of fiber material by the interior pressure of the fluid. The outer coating has the advantage that it simultaneously forms a smooth, washable outer coating.

In accordance with a preferred embodiment of the invention, the hose is sealingly clamped on its end between two strips. Particularly in the case where the hose in coated on the interior with an elastomer, the hose ends are well sealed with small clamping forces. The connection of the strips with each other can be made by means of rivets or screws, for example.

In accordance with a further embodiment of the invention, the ends of the hose are welded or glued. This variant is advantageous especially in cases where the hose does not have an inner elastomer coating.

The ends of the hose are preferably pressed together by folds. Not only do the folds hold the hose together at the ends, but they also form a protection for the edges against mechanical damage. The flat ends of the hose preferably have rounded edges. Furthermore, the folds preferably have C-shaped profiles which are curved around the rounded-off edges at the end and are adapted to their shape. By means of this, corners and edges at the hose end and the danger of damage connected therewith are prevented. The ends are protected from wear by the folds.

It is of course advantageous to provide the hose with a closeable opening for replenishing the fluid.

Lifting devices of the type described at the outset are particularly intended to lift handicapped persons such as those in wheelchairs from a seated position and to move them and then to put them down on another seat, for example that of a toilet facility. The traction element is tightened by the upward turning of the lifting arm or the lifting arms around an essentially horizontal axis and the person is lifted. It is disadvantageous that the position of the lifting arm at which lifting of the person starts depends on the height of the person and how high above the floor the seat surface is. Accordingly, the direction of pull is different. This can have the result that tall persons in particular are not so much lifted, instead their upper body is being pulled forward. Since as a rule those in wheelchairs are unable to straighten their legs by themselves, their buttocks are not lifted but pulled forward if the worst comes to the worst, so that there is the danger of the person falling off the seat. To counteract this danger it is known to provide a knee rest on the support for supporting the knees.

It is therefore a further object of the invention to design a lifting device in such a way that the traction forces acting on a seated person act in a desired direction, in particular steeply upward, which is independent of the size of the person or the height of its seat. In this connection it should not be necessary to change the length of the traction element. At the same time the position of the knee rest which is disposed on the support should be fixed. Furthermore, it should be possible to suspend the traction element from the attachment point detachably in a simple but reliable manner, so that the danger of an accident because of a spontaneous detachment of the suspension is small.

The object is attained in accordance with the invention in that the position of the horizontal axis is height-adjustable. Thus, the lifting arm is not only rotatable around the horizontal axis, but also vertically adjustable. The height of the support in particular is adjustable. An alternative option would consist in an adjustable design of the connection between the lifting arm and the support which, however, would require an increased outlay. If the length of the support is variable, there is the additional advantage that the height of the lifting device as a whole can be reduced.

In the embodiment of the invention, the support consists of an elongated profiled section, such as a square tube, around which a second elongated profiled section is disposed like a square tube, wherein the second elongated profiled section is displaceable in respect to the first elongated profiled section. Displacement can be effected by means of an electric motor or a hand crank. However, other drives are also possible, such as via lifting cylinders.

In a further embodiment of the invention, a knee rest for supporting the knees of persons who are to be lifted from the seating position is disposed on a height-adjustable part of the support. This knee rest is preferably attached to the outer second elongated profiled section. In this way the position of the knee rest is changed simultaneously with the adjustment of the support. The support is moved upward for lifting a tall person. In this case the knee rest is also in a high position which fits the position of the lower legs of a tall person.

Further details, advantages and features of the invention ensue not only from the claims or the features which can be found in them—by themselves and/or in combination—, but also from the subsequent description of a preferred exemplary embodiment to be taken from the drawings, as well as the subsequent examples which explain the invention. Shown are in:

BRIEF DESCRIPTION OF THE DRAWINGS

FIG. 2, a side view of another lifting device for lifting seated persons, and FIG. 3, a side view of a suspension member.

DETAILED DESCRIPTION OF THE DRAWINGS

Figure 1:
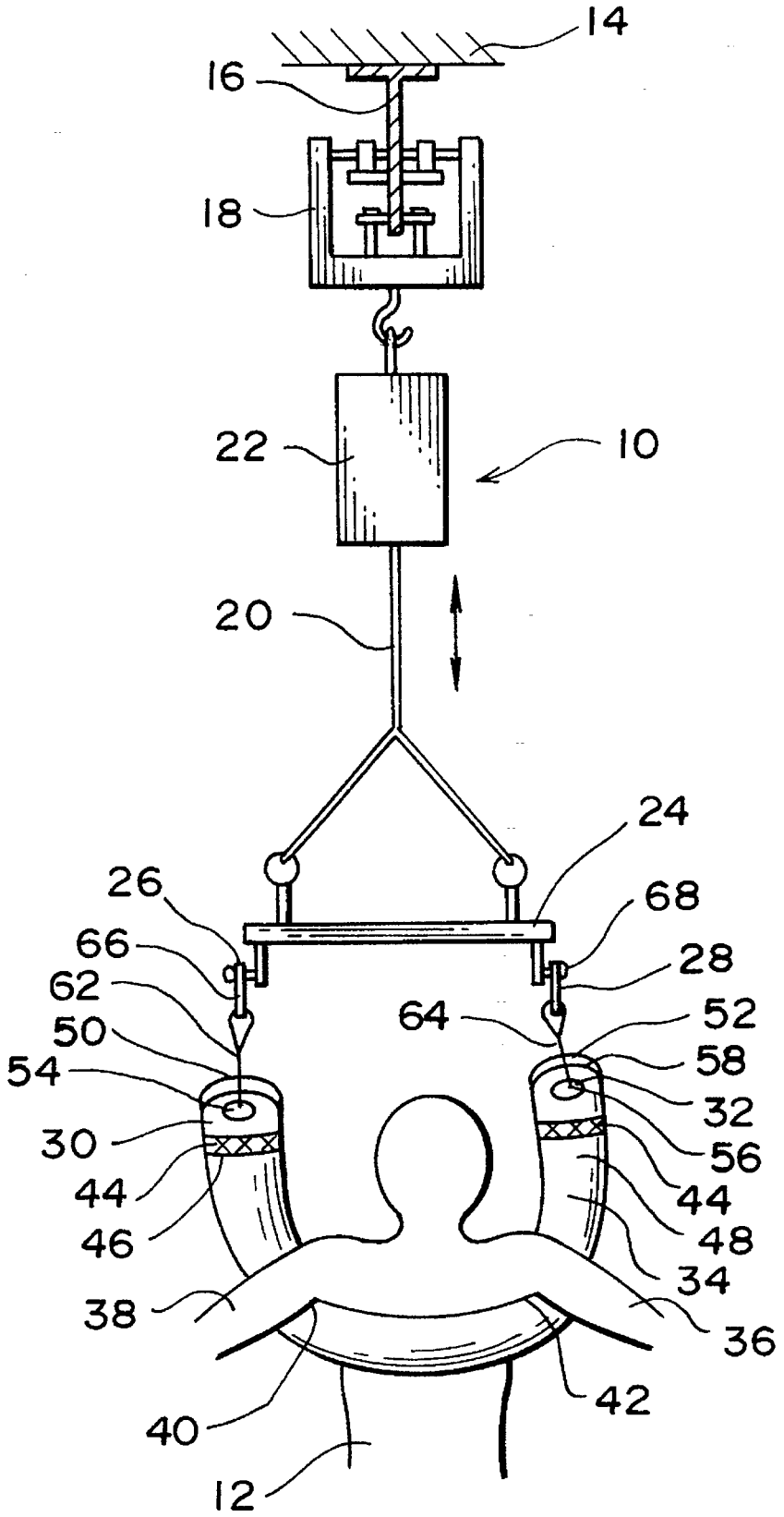
FIG. 1, a side view of a lifting device fastened on a ceiling.

A lifting device (10 for lifting or transporting a handicapped person (12) is horizontally adjustable via a rail (16) by means of a rolling device (18) on the ceiling (14)of a room, for example. The roller device (18) is connected via a cable (20) and a reel (22) with a lifting arm (24). In this case the reel (22) winds the cable (20) and in this way shortens the distance between the lifting arm (24) and the ceiling (14) of the room. The reel is driven by a motor, not shown.

Attachment points (26), (28) for the ends (30), (32) of a hose (34) as a traction element are disposed on the lifting arm (24). The hose (34) is passed under the arms (36), (38) in the vicinity of the armpits (40), (42) of the person (12) to be lifted. In this case the hose (34) can either be passed around the chest or the back of the person (12). The hose (34) is filled with a fluid, such as air or water. The surface of the hose is deformable so that it comes to rest over a large surface of the body of the person. The hose (34) is indented, in particular at places where exterior forces act on the hose surface, such as underneath the armpits (40), (42) .

Uncomfortably large force effects on the person are avoided because the hose (34) adapts to the person (12).

Preferably the hose (34) has a diameter between 5 cm and 20 cm, so that on the one hand it still fits comfortably under the armpits (40), (42) and, on the other hand, has a large contact surface with the body of the person (12).

The hose (34) seals in the fluid. In addition, the hose is elastically deformable. The pressure of the fluid enclosed in the hose (34) is increased because of the pressure between the hose (34) and the person (12). In this way the hose (34) becomes somewhat stiffer if a person (12) is suspended from it.

The ends (30) and (32) of the hose (34) are clamped flat and sealingly between respectively two strips (44). The strips are firmly connected with each other by means of respective connecting elements (46), such as screws or rivets. Alternatively, it is possible for the ends (30), (32) of the hose (34) to be welded or glued. A closable opening (48) for refilling fluid is disposed preferably in the vicinity of one end (32). The ends (30), (32) of the hose (34) are pressed together by folds (50), (52) and convexly curved, so that there are no sharp edges. The folds (50), (52) preferably have a C-shaped profile.

Straps (54), (56) are disposed at the ends (30), (32) . The straps (54), (56) are preferably rounded and their edges are bordered by flanges (58), (60). Preferably longitudinally adjustable belts (62), (64) are passed through the straps (54), (56). The straps (54), (56) are arranged in a sealing face between the strips (44) and an end edge between the folds (50), (52). A device for changing the length of the belts (62), (64) is not shown.

The belts (62), (64) are fastened to suspension members (66), (68). The suspension members (66), (68) are suspended from nipples (26), (28), which constitute the attachment points.

A suspension member (68) is shown in FIG. 3. The belt (64) is passed through a slit (70). The suspension member (68), which has the shape of a plate, has a recess in the form of an elongated opening (72) in its very large surface. The elongated hole (72) has a widening (74). A nipple (69), which is connected with the lifting arm (24), can be inserted through this widening (74). In this case the nipple head (69) is large enough that although it fits through the widening (74), it does not fit through the actual elongated opening (72). The elongated opening (72) has an end in the form of the widening (74) which is disposed close to the belt (64). Another end (76) of the elongated opening (72) is disposed farther distant from the belt (64).

The elongated opening (72) is embodied in the form of an elbow with two legs (78), (80), wherein the one leg (78) is oriented in the direction of the belt (64) and the other leg (80) away from the belt (64). The widening (74) is disposed at the end of the leg (78). When the nipple (69) has been inserted into the widening (74), the shaft of the nipple can be displaced in the elongated opening (72) along the legs (78), (80) to the end (76) of the elongated opening (72).

The direction of the tensile strain (82) is directed downward, obliquely downward or horizontally toward the left. The suspension member (68) is accordingly pivoted in the direction of the arrows (84), (86). Regardless of the direction in which the tensile strain (82) acts, the leg (80) of the elongated opening (72) is oriented upward toward the end (76). By its own weight the suspension member (68) always prevents in this way an independent movement of the nipple (69) away from the end (76) and toward the widening (74). The suspension member (68) can therefore only be taken off the nipple (69) if it is lifted.

FIG. 2 shows a further exemplary embodiment of a lifting device (10) for lifting a sitting person (12). The lifting device (10) has a stand (100), which can be rolled on the floor (106) by means of casters (102), (104). A foot rest (108) is disposed on the stand (100). An upwardly extending support (110) is connected with the stand. The height of the stand (110) can be adjusted in the direction of the two-headed arrow (112). The support (110) consists of an inner elongated profiled section (114) and an outer profiled section (116) enclosing it. The profiled sections (114), (116) can be angular or round hollow profiled sections. The outer profiled section (116) can be pushed along the inner profiled section (114). A motor-gear device (118) causes the movement in the direction of the arrow (112). A lifting arm (120) is disposed at the top of the support (110). The lifting arm (120) is rotatable around a horizontal axis (122). The lifting arm (120) can also be a double arm. The lifting arm (120) is rotated in the direction of the two-headed arrow (124). This movement is performed by means of a further motor-gear device (126), in which a battery can be disposed. The operation of the motors (118), (126) is controlled by means of a manual control element (128), which can be operated by the person (12) himself. A knee rest (130) is disposed on the height-adjustable elongated profiled section (116).

The attachment point (132), which can be a nipple, is disposed at the end of the lifting arm (120). An end (134) of a hose (34) can be fastened on the attachment point (132) by means of a suspension member, not shown, and a belt. In this case the connecting belt is preferably adjustable in length. The hose (34) is passed under the arms and around the back of the person (12) for lifting him from the seat (136). The other end of the hose (34) is not shown. It can be connected to the lifting arm (120) with a further attachment point, not visible. This further attachment point is disposed further to the left when viewed from the person (12).

Lifting of the person (12) takes place as follows:

First the lifting device (10) is positioned by the person (12) in such a way that he can put his feet on the foot rest (108) and his knees rest against the knee rest (130). With the support (116) moved downward and the lifting arm (120) lowered, the hose (34) is passed around the person (12) and fastened on the attachment point (132). Subsequently the support (116) is lengthened until the hose is taut. In this case the lifting arm (120) is pivoted down. The length of the hose (34) in this case should be such that, although the hose (34) can be passed loosely around the body of the person (12) and can be suspended at the attachment point, only a small lifting motion is required for tightening the hose (34). If the length of the hose (34) does not meet the requirements, the length of the belt between the hose end (134) and the attachment point (132) can be extended. The required adjustment of the hose length can also be omitted if persons (12) of different height are to be lifted from seat (136) of different seat height.

Once the hose (34) sits closely, the lifting arm (120) is pivoted up and/or the support (110) is further extended for lifting the person (12) off the seat (136). Lowering of the person (12) takes place in the reverse sequence of the operational steps.

It is possible either to push a special seat, for example a movable toilet chair, under the lifted person (12), or the lifted person can be transported to another seat by moving the lifting device.

I claim:

1. A lifting device (10) for a handicapped person (12), comprising a traction element (34) for placement under the armpits (40, 42) of the person to be lifted and transported, a height-adjustable lifting arm (24) including attachment points (26, 28) for the ends (30, 32) of the traction element, wherein said traction element is an elastic hose made of a fiber material, such as polyamide, which is sealingly coated with an elastomer and the hose is filled with a fluid.

2. A lifting device in accordance with claim 1, wherein the fluid in the traction element is a gas, such as air.

3. A lifting device in accordance with claim 1, wherein the hose is coated with a smooth, washable outer covering.

4. A lifting device in accordance with claim 1, wherein two ends (30, 32) of the hose are sealingly clamped between two strips (44).

5. A lifting device in accordance with claim 1, wherein the ends (30, 34) of the hose are pressed together by folds (50, 52).

6. A lifting device in accordance with claim 1, wherein the ends (30, 32) of the hose are glued.

7. A lifting device in accordance with claim 1, wherein straps (54, 56) are provided at the ends (30, 32) of the hose.

8. A lifting device in accordance with claim 7, wherein the straps (54, 56) are beaded into flat ends (30, 32) of the hose.

9. A lifting device in accordance with claim 1, wherein the hose has convexly curved end edges (50, 52).

10. A lifting device (10) for a handicapped person (12), comprising a traction element (34) for placement under the armpits (40, 42) of the person to be lifted and transported, a height-adjustable lifting arm (24) including attachment points (26, 28) for the ends (30, 32) of the traction element wherein said traction element is an elastic hose whose ends (30, 32) are welded and the elastic hose is filled with fluid.

11. A lifting device for a handicapped person comprising a U-shaped traction element for placement under the armpits and around the upper body of the person to be lifted, a height-adjustable lifting arm including attachment devices for the U-shaped traction element, said traction element is in the form of an elastic, fluid filed hose with sealed ends so that the traction element conforms to the person's body to be lifted, and the contact pressure against the body is evened out.

* * * * *